US005676197A

United States Patent [19]

Diebold et al.

[11] Patent Number: 5,676,197

[45] Date of Patent: Oct. 14, 1997

[54] MOUNTING FOR DRIVE MECHANISM OF HEAT EXCHANGER SCREEN CLEANING WAND

[75] Inventors: David Henry Diebold; Alan Joseph Novak, both of Ottumwa; Robert James Johnston, Oskaloosa; John Lewis Rukgaber; Larry Allen Workman, both of Ottumwa, all of Iowa

[73] Assignee: Deere & Company, Moline, Ill.

[21] Appl. No.: 690,701

[22] Filed: Jul. 30, 1996

[51] Int. Cl.[6] ..... F28F 19/01; F28G 3/00

[52] U.S. Cl. ..... 165/41; 165/95; 165/119; 55/269; 55/294; 55/385.3; 180/68.6

[58] Field of Search ..... 165/95, 119, 41; 55/385.3, 269, 294; 180/68.1, 68.6

[56] References Cited

U.S. PATENT DOCUMENTS

| | | | |
|---|---|---|---|
| 2,601,704 | 7/1952 | Streun | 55/294 |
| 3,377,780 | 4/1968 | Noland | 55/294 |
| 4,036,613 | 7/1977 | Brown et al. | 55/294 |
| 4,082,524 | 4/1978 | Noland | 55/294 |
| 4,443,236 | 4/1984 | Peiler | 55/269 |
| 4,542,778 | 9/1985 | Bagnall et al. | 165/95 |

FOREIGN PATENT DOCUMENTS

| | | | |
|---|---|---|---|
| 1467230 | 3/1989 | U.S.S.R. | 165/119 |

*Primary Examiner*—Leonard R. Leo

[57] ABSTRACT

A self-propelled windrower includes an engine compartment containing an engine-driven fan for pulling cooling air through a screen covering a circular air inlet leading into the compartment. The fan also is coupled for creating a suction in an air duct extending diametrically across the air inlet, the duct in turn being coupled to the center of a channel-like vacuum wand mounted for sweeping the exterior of the screen and removing airborne debris collected by the screen. Provided for rotatably supporting a drive shaft for the wand is a bearing support member including a cylindrical portion having an end fixed to a mounting plate secured to the air duct, the cylindrical portion having an interior end section receiving an outer race of a roller bearing having an inner race receiving and being fixed to the wand drive shaft. An electric drive motor is located within said compartment and mounted to said air duct at a side thereof remote from said screen. The electric motor is, for example, of a type normally used for driving windshield wiper blades and includes a main body disposed at a right angle to an output shaft coupled to the wand shaft by a wedge fit formed by respective frusto-conical surfaces of the motor output shaft and the wand drive shaft. The motor output shaft projects through a hole provided in the mounting plate of the bearing support member, the hole having an axially short pilot portion to accurately position the motor output shaft relative to the wand drive shaft to minimize misalignments, and secondly to minimize the binding of the motor shaft.

10 Claims, 4 Drawing Sheets

MOUNTING FOR DRIVE MECHANISM OF HEAT EXCHANGER SCREEN CLEANING WAND

BACKGROUND OF THE INVENTION

The present invention relates to rotary vacuum wands for cleaning crop residue, and the like, from screens or filters located upstream of heat exchangers of agricultural vehicles or off road vehicles, and more specifically, relates to drive assemblies for such wands.

Agricultural vehicles, e.g., self-propelled windrowers, combines and cotton harvesters, work in environments where crop residue and other debris becomes airborne. These vehicles are equipped with fans for drawing a stream of cooling air through spaces provided between finned tubes of heat exchanger cores, such as those for removing heat from engine coolant, engine charge air, transmission oil and air conditioner condensers, for example. To prevent such crop residue and other airborne debris from collecting in and plugging these spaces, screens are provided in the air stream to intercept a large percentage of these airborne materials. So that an operator need not make frequent stops to clean collected debris off the screen that would otherwise prevent sufficient air flow through the screen, it is known to provide a vacuum system including a vacuum duct located on an interior side of the screen and coupled, by way of a centrally located hole in the screen, to a central zone of a channel-like wand or sweep rotatably mounted exteriorly of the screen so as to sweep closely adjacent to, and suck debris from, the screen.

U.S. Pat. No. 4,443,236 issued to Peiler on 17 Apr. 1984 shows such a vacuum system wherein a propeller is mounted together with the wand for being rotated in response to the stream of air being drawn in through the screen, the propeller thus driving the wand. This approach is not entirely satisfactory since the propeller is not positively driven and may result in the wand being stopped from rotating by collected debris, and also since the support arrangement for the propeller and wand is not aesthetically pleasing.

Another patent disclosing a vacuum system for continuously removing debris from an exterior surface of a screen is U.S. Pat. No. 4,542,785 issued to Bagnall et. al. on 24 Sep. 1985. The wand or sweep of this patent is positively driven by a belt and pulley drive including a jack shaft located on the outside of the compartment and connected to be driven together with the engine fan, the rotation of the jack shaft being transferred to a pulley located on a shaft carrying the wand. However, for the sake of safety, a box-like shield or cover is provided over that portion of the drive extending between the jack shaft and the wand. Such a shield adds to the cost of the assembly and those portions of the wand drive left unshielded detract from the aesthetics of the assembly.

SUMMARY OF THE INVENTION

According to the present invention there is provided an improved vacuum arrangement for removing debris from a screen-type air filter located in the stream of cooling air being drawn through one or more heat exchangers located in a compartment, and more particularly, there is provided an improved drive for the vacuum wand or sweep of such arrangement.

An object of the invention is to provide a vacuum arrangement, for removing debris from a foraminous air filter, including a rotary wand or sweep having a relatively simple drive mounted so as to be functional while not detracting from the aesthetics of the arrangement.

A more specific object of the invention is to provide a drive for a rotary wand wherein the wand drive shaft is mounted to and thus supported by a vacuum duct located at the inner side of a screen.

Yet another specific object of the invention is to provide a drive for a rotary wand, as set forth in the immediately preceding object, wherein an electric motor, for example, a type typically used for driving a windshield wiper, is mounted to the vacuum duct and connected directly to the wand drive shaft.

Still another object of the invention is to provide a drive for a rotary wand, as set forth in the immediately preceding object, wherein the wand drive shaft is fixed to an inner race of a bearing having its outer race carried by a bearing support to thereby prevent axial loads from being transferred from the wand drive shaft to the output shaft of the electric motor.

These and other objects will become more apparent from a reading of the ensuing description together with the appended drawings.

DESCRIPTION OF THE PREFERRED EMBODIMENT

Figure 1:
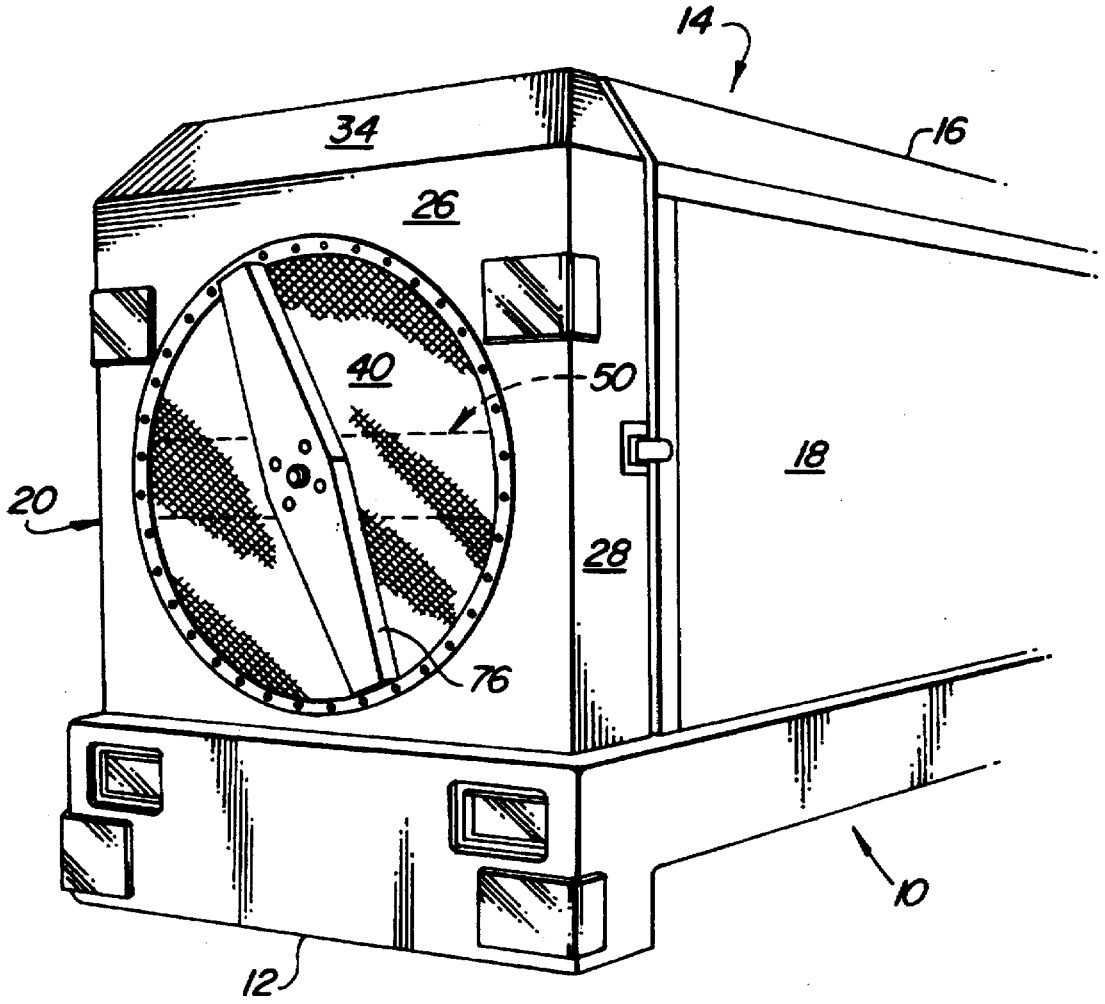
FIG. 1 is a right rear perspective view of an engine compartment of a self-propelled windrower showing a door forming the rear of the compartment and containing an air inlet opening covered by a screen for intercepting and collecting foreign matter entrained in a stream of cooling air being drawn into the compartment and showing a powered vacuum wand for continuously removing such foreign matter from the screen.
Figure 2:
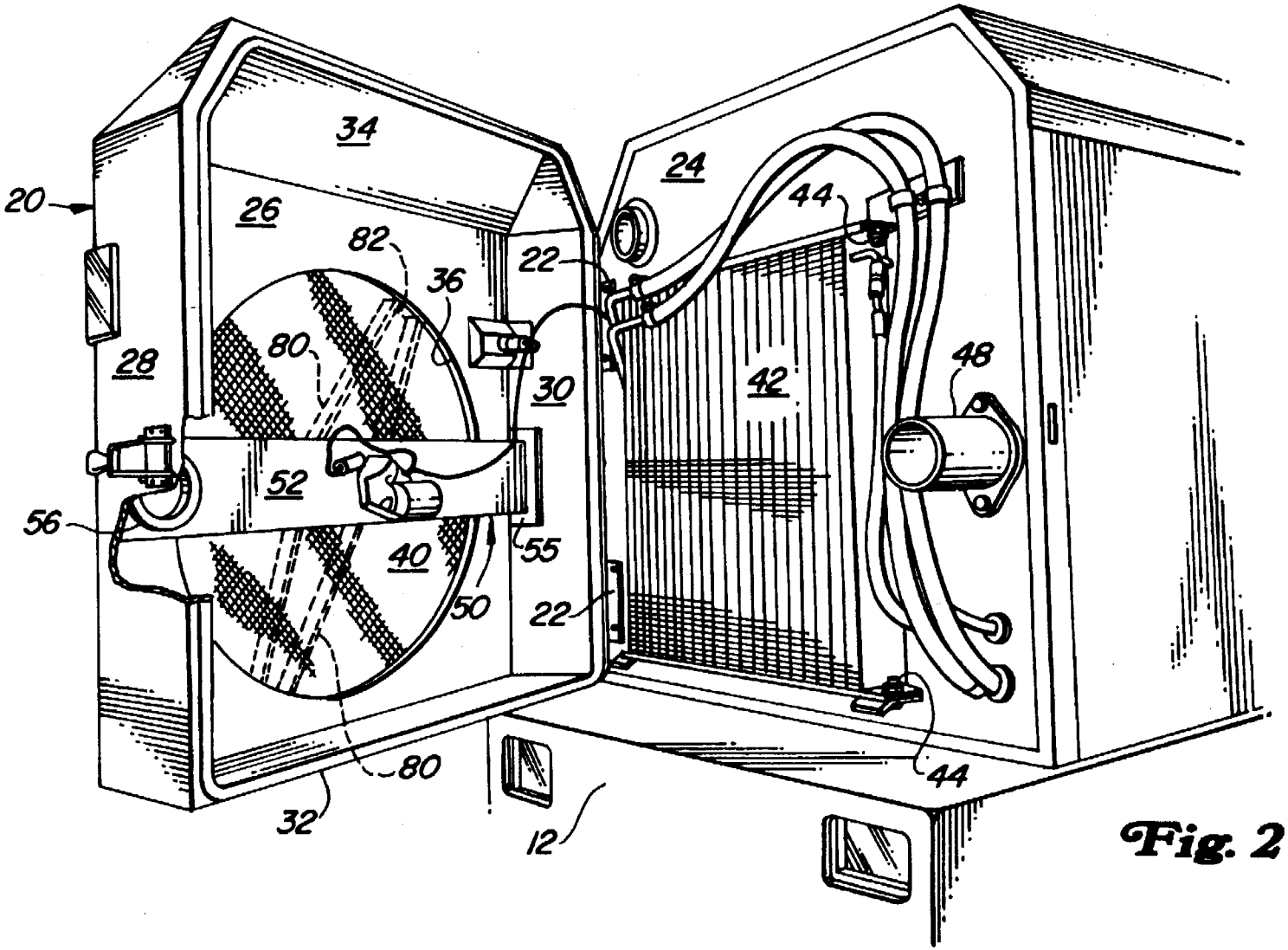
FIG. 2 is a right rear perspective view of the rear portion of the compartment shown in FIG. 1, but showing the door swung to an open service position revealing a heat exchanger located immediately downstream from the screen and revealing an electric motor mounted to the inside of the door for driving the vacuum wand.
Figure 3:
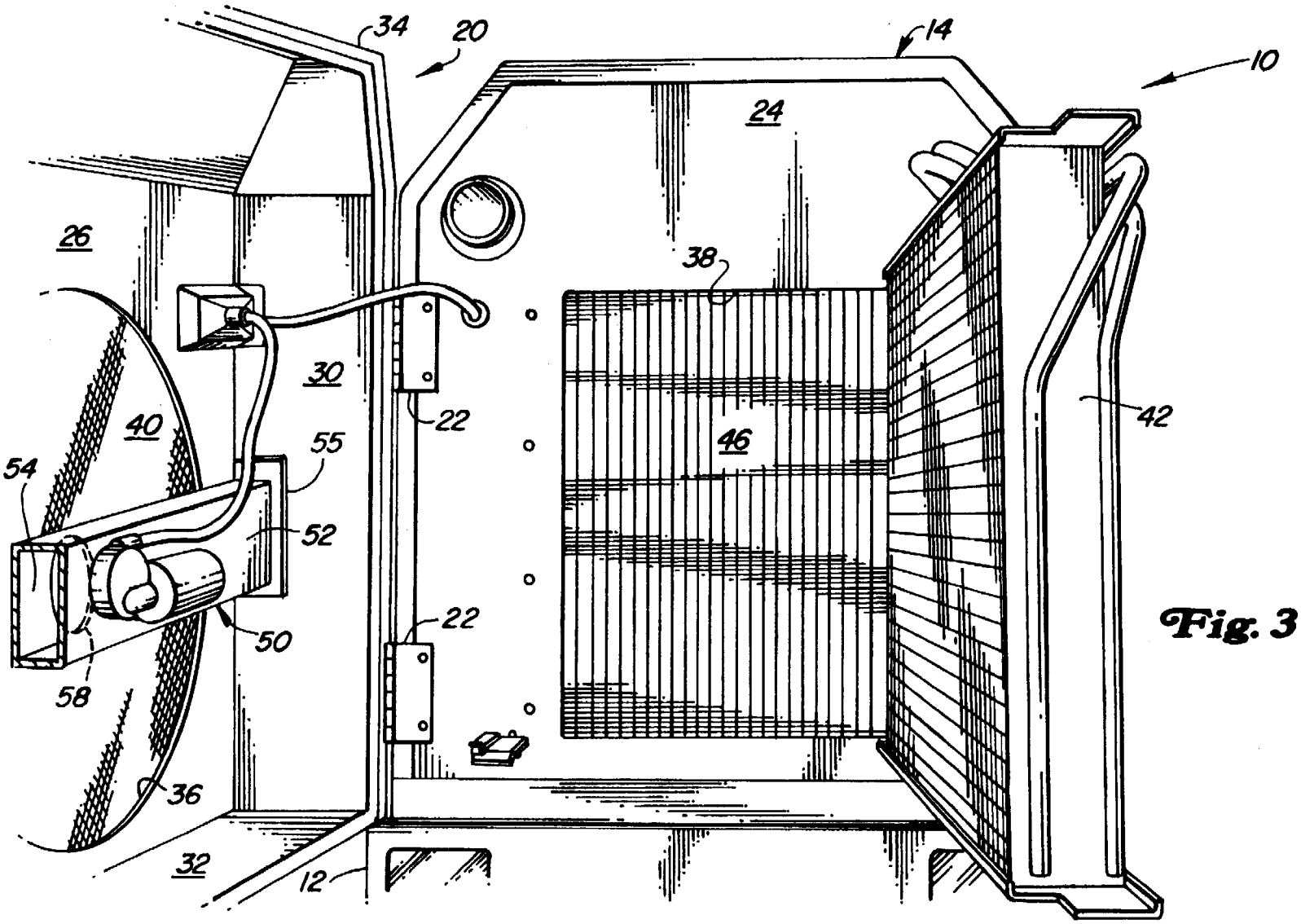
FIG. 3 is a rear perspective view of the engine compartment showing the door at the rear of the compartment and the joint heat exchanger assembly, defined by the condenser and oil cooler cores, pivoted to their respective open servicing positions, and showing the core of a radiator located forwardly of a rectangular passage provided in an interior wall of the compartment.

Referring now to FIG. 1, there is shown a rear portion of an agricultural vehicle configured as a self-propelled windrower 10 including a main frame 12 supporting an internal combustion engine (not shown) located within an engine compartment 14. Referring now also to FIGS. 2 and 3, it can be seen that the compartment 14 is substantially enclosed by a top 16, opposite side panels, of which only the right side panel 18 is shown, and a rear end in the form of a door 20. The door 20 is hinged for pivoting horizontally between a closed position (FIG. 1) and an open or service position (FIGS. 2 and 3) about a vertical axis, defined by a pair of hinges 22 respectively fixed to vertically spaced locations at a left side of the door 20 and of an interior vertical compartment wall 24. The door 20 is defined by a vertical rectangular wall 26, that is spaced rearwardly from and disposed parallel to the interior compartment wall 24 when the door 20 is in its closed position (FIG. 1), with vertical right and left side walls 28 and 30, respectively, a horizontal bottom wall 32 and a multi-faceted top wall 34 being joined to, and extending forwardly from, the vertical wall 26.

Provided for permitting a stream of ambient cooling air to be drawn into the compartment 14 by an engine-driven fan (not shown) located within the compartment is a circular air passage 36 located in the door wall 26 (FIGS. 2 and 3) and a rectangular air passage 38 (FIG. 3) located in the interior compartment wall 24 in fore-and-aft alignment with the opening 36. The opening 36 in the door 20 is covered by a foraminous debris screen or filter 40. Mounted to a rear or outer surface of the wall 24 is a core of an air conditioner condenser and a core of an oil cooler combined to form a heat exchanger 42 having the cores positioned in blocking relationship to the air passage 38 and being mounted for pivoting horizontally about a vertical axis, defined by vertically spaced pivot connections 44, between a closed operating position, shown in FIG. 2, and an open service position, shown in FIG. 3. Located just forwardly of the rectangular air passage 38 in the compartment interior wall 24 is an engine coolant heat exchanger or radiator 46. In typical fashion, the vehicle engine-driven fan is located ahead of the radiator 46 and acts to draw a stream of ambient cooling air into the engine compartment by way of the screen 40 and heat exchangers 42 and 46.

A vacuum system is provided for continuously cleaning debris from the rear surface of the screen 40. Specifically, the vacuum system includes a cylindrical aspirator or suction tube 48 which extends though the compartment inner wall 24 at a mid-height location at the right side of the wall. The engine-driven fan acts to create a suction in the tube 48. A horizontal air duct 50 of rectangular cross section includes vertical front and rear walls 52 and 54, respectively, with the rear wall 54 being positioned just forwardly of the door wall 26. The duct 50 extends diametrically across the air passage 36, and welded in closing relationship to opposite ends of the duct 50 and to the right and left side walls 28 and 30 of the door 20 are rectangular mounting plates, only a left plate 55 being shown. Located in a rightward location of the front wall 52 of the tube 50 is a circular opening to which is mounted an annular seal 56, of resilient foam material, which is compressed by the suction tube 48 when the door 20 is closed (FIG. 1).

Figure 4:
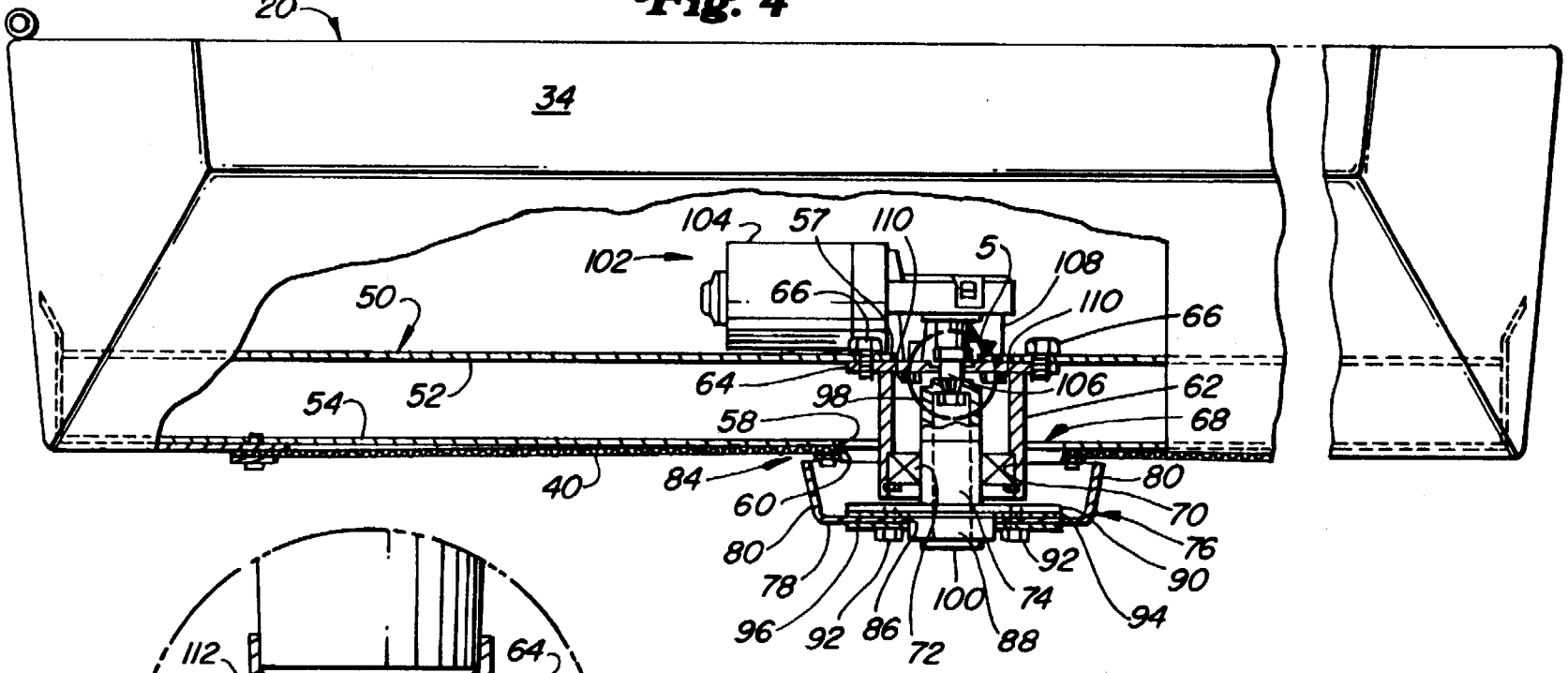
FIG. 4 is a top view of the door shown in FIG. 1, with some portions being broken away and others in section revealing the connection between the motor drive shaft and the vacuum wand shaft.
Figure 5:
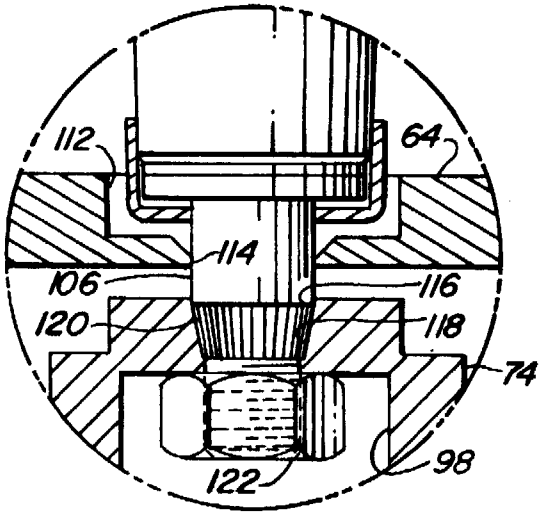
FIG. 5 is an enlargement of the circled area 5 of FIG. 4 showing the mounting of the wand drive motor output shaft to the wand drive shaft and the pilot hole in the wand drive shaft bearing support for effecting proper alignment of the motor output shaft with the wand drive shaft.

Referring now also to FIGS. 4 and 5, it can be seen that axially aligned circular openings 57 and 58, respectively, are provided in the front and rear duct walls 52 and 54 in coaxial relationship to the circular air passage or opening 36. As can best be seen in FIG. 4, the screen 40 is provided with a centrally located circular hole 60 disposed in axial alignment with the circular openings 57 and 58. A cylindrical bearing support member 62 has a circular mounting plate 64 welded across its forward end, the plate 64 being secured against a rearward surface of the duct front wall 52 by a set of screws 66 that respectively extend through a set of mounting holes in the wall 52 and are screwed into a set of threaded holes provided in the mounting plate 64. It is here noted that while the support member 62 and plate 64 are here shown as a weldment, their function could just as well be performed by a unitary casting.

The bearing support member 62 projects rearwardly from the plate 64 through the opening 58 provided in the rear wall 54 of the duct 50 and through the centrally located hole 60 provided in the screen 40, with the member 62 being smaller in diameter than the openings 58 and 60 so that an annular air inlet 68 is defined between the member 62 and the screen 40 and the duct 50. Provided in the interior of a rearward end section of the bearing support member 62 is a recessed cylindrical surface 70 into which is pressed an outer race of a ball bearing 72, with it being noted that other types of bearings would be suitable. Slipped into an inner race of the bearing 72, so as to be supported for rotating about a horizontal axis, is a wand drive shaft 74. The shaft 74 is secured with adhesive, for example, to the bearing inner race to prevent axial loads from being transmitted along the shaft 74. A channel-like vacuum wand 76 extends diametrically across and closely adjacent to a rear surface of the screen 40. While the wand 76 could take on a variety of forms and still be functional, it is shown here as including a web 78 which becomes narrower in opposite directions from its center and is joined to opposite flanges 80 angled slightly greater than 90° from the web so as to diverge from each other. While opposite ends of the channel defined by the web 78 and flanges 80 of the wand 76 could be open, they are here shown closed by end plates 82, of which only one is visible (FIG. 2). Free edges of each of the flanges 80 and plates 82 are disposed so as to define a small gap 84, of substantially constant dimension, between the wand 76 and the screen 40. The wand web 78 is provided with a hole 86 located centrally between opposite ends of the wand 76 and received in the hole 86 is an enlarged cylindrical rear portion 88 of the wand drive shaft 74. Joined to the forward end of the cylindrical portion 88 is an annular mounting plate 90 engaged with a forward surface of the wand web 78 and being provided with a set of threaded mounting holes aligned with holes provided in the web 78. A set of cap screws 92 are respectively received in the web holes and threaded into the mounting plate holes. An annular shim 94 is mounted on the end portion 88 of the wand drive shaft 74 and held sandwiched between the mounting plate 90 and a front surface of the wand web 78 by the screws 92 for the purpose of adjusting the gap 84 between the wand 76 and the screen 40. Other shims, such as shim 96 for example, may be stored at the backside of the wand web 78 with the screws 92 holding these shims in storage for possible insertion at the forward side of the wand web 78 if a larger gap between the wand 76 and screen 40 is desired. An access bore 98 extends axially into the shaft 74 from its rear end and has its entrance closed by a removable plug 100. A wand drive motor 102, for example, of a type typically used for driving vehicle windshield wipers, includes a cylindrical main body portion 104 disposed at a right angle relative to a drive shaft 106. It is noted that the wand drive shaft 74 is approximately three times larger in diameter than the motor drive shaft 106, which makes it desirable from the standpoint of motor drive shaft and bearing life, that the loads imposed on the wand drive shaft not be transferred to the motor drive shaft 106 but rather be borne mostly by the wand drive shaft 74 and support bearing 72. The motor drive shaft 106 projects from a mounting portion 108 which forms part of a transmission housing having a flat surface fixed against a front surface of the bearing support mounting plate 64 by a set of capscrews 110 which extend forwardly through holes provided in the plate 64 and are received in threaded holes provided in the motor mounting portion 108. As can best be seen in FIG. 5, the motor drive shaft 106 projects rearwardly through a bore 112 provided in the bearing support mounting plate 64, the bore 112 including an inwardly stepped rearward end section defining a pilot hole 114 sized to closely receive and thus accurately position the motor drive shaft 106 relative to the bearing mounting surface 70 to provide proper alignment between the motor drive shaft 106 and wand drive shaft 74. The pilot hole 114 is of short axial length (approximately 1 mm) so as to minimize binding between the hole 114 and the shaft 106 due to misalignment. The wand drive shaft 74 is provided with an opening 116 leading axially into the access bore 98 and including a central frusto-conical section 118 which is tapered so as to diminish in diameter from front to rear. The motor shaft 106 extends through the opening 116 and includes a knurled frusto-conical section 120 shaped such as to be held in tight engagement with the opening section 118 by a nut 122 threaded onto threads provided on a rear end portion of the motor shaft 106. During assembly, access for installing the nut 122 is provided through the access bore 98 prior to the installation of the removable plug 100. It is here noted that other complimentary motor shaft and wand drive shaft opening shapes could be used for coupling the shafts together; or the motor shaft could be keyed in place in the opening.

Thus, it will be appreciated that due to the wand drive motor 102 having its output shaft 106 disposed at a right-angle to its body 104 and due to the wand drive shaft bearing support member 62 being mounted so as to make use of the space taken up by the air duct 50 and wand 76, the wand drive assembly is axially compact. Further, with the drive motor 102 being located interiorly of the door 20 and hence inside the screen 40, a safer and/or more attractive design results than would be the case if the motor 102 were mounted on the exterior of the door 20 with a second door perhaps being provided for covering the motor. Additionally, it should be noted that axial loads on the wand drive shaft 74 are borne by the bearing 72 and, therefore, not transferred to the relatively small motor drive or output shaft 106 and bearing (not shown) supporting the shaft 106.

We claim:

1. In combination with a vehicle including an enclosed compartment containing a driven fan for drawing a stream of ambient air through a first opening provided in an exterior wall of the compartment and covered by a screen for collecting debris airborne in said stream, and a heat exchanger located in said compartment between said fan and said first opening so as to have said stream of ambient air pass therethrough, a vacuum system for removing from said screen said debris collected by said screen, comprising: a tubular suction duct having opposite closed ends and being mounted inside said compartment adjacent to an interior surface of said screen; said duct extending radially from a center of a circular area of said screen; said screen having an opening at said center of said circular area and said duct having an air inlet registering with said opening in said screen; a vacuum wand extending radially from said center of said circular area of said screen; said wand being channel-like and being mounted such that it opens toward, and has opposite flanges disposed closely adjacent to, an exterior surface of said screen so as to define a small clearance gap; a tubular bearing support member being mounted to said duct and projecting centrally through said air inlet of said duct and said opening in said screen and between said flanges of said wand; a wand drive shaft extending axially within said bearing support member; bearing means mounting said vacuum wand to said bearing support member for rotating about an axis containing said center of said circular area and for sweeping said circular area of said screen; and power means located within said compartment and coupled to said wand drive shaft.

2. The combination defined in claim I wherein said power means is an electric motor having an output shaft; and coupling means securing said output shaft directly to said wand drive shaft.

3. The combination defined in claim 1 wherein said wand drive shaft includes an access bore extending axially therein from an end located exteriorly of said screen; said power means including an output shaft having a mounting section tapered outwardly from a threaded end section; said wand drive shaft including a tapered opening leading to said access bore and shaped complimentary to and receiving said mounting section of said output shaft; and a nut being received on said threaded end section of said output shaft and clamping said tapered opening of said wand drive shaft and tapered section of said output shaft together.

4. The combination defined in claim 3 wherein said bearing support member includes a wall at one end thereof; a hole being provided in said wall and including a pilot section of short axial dimension bounded by a thin wall having said output shaft slidably mounted therein whereby said pilot section accurately positions the motor output shaft relative to the wand drive shaft bearing bore to minimize misalignment between the motor shaft and the wand drive shaft, and also to minimize binding at the motor output shaft due to misalignment of said shaft in said pilot section.

5. The combination defined in claim 4 wherein said power means is an electric motor having a main body portion disposed at a right angle to said output shaft; and said electric motor being mounted between said heat exchanger and said suction duct.

6. The combination defined in claim 1 where in said suction duct extends diametrically across said circular area of said screen.

7. The combination defined in claim 1 and further including means for adjusting said clearance gap between the flanges of said vacuum wand and said screen.

8. The combination defined in claim 7 wherein said wand drive shaft includes a mounting flange engaged with a web of said wand; fastener means coupling said mounting flange to said web; and said means for adjusting includes one or more shims mounted between said mounting flange and said web.

9. The combination defined in claim 1 wherein said power means includes an output shaft having a diameter no larger than about half that of said wand drive shaft and being coupled to said wand drive shaft; securing means fixing said wand drive shaft to said bearing means, whereby loads on said wand are transferred mainly to said bearing means and not to said smaller output shaft of said power means.

10. The combination defined in claim 1 wherein said power means is an electric motor; said bearing means includes outer race fixed to an inner surface of said bearing support and includes an inner race; and said securing means including an adhesive joining said wand drive shaft to said inner race of said bearing means.

* * * * *